US008950780B2

(12) United States Patent
Betz et al.

(10) Patent No.: US 8,950,780 B2
(45) Date of Patent: Feb. 10, 2015

(54) SEAT BELT BUCKLE AND SEAT BELT SYSTEM FOR A VEHICLE

(75) Inventors: Hans-Peter Betz, Boebingen (DE); Peter Haas, Eschach (DE)

(73) Assignee: TRW Automotive GmbH, Alfdorf (DE)

( * ) Notice: Subject to any disclaimer, the term of this patent is extended or adjusted under 35 U.S.C. 154(b) by 100 days.

(21) Appl. No.: 13/193,688

(22) Filed: Jul. 29, 2011

(65) Prior Publication Data

US 2012/0187742 A1 Jul. 26, 2012

(30) Foreign Application Priority Data

Aug. 14, 2010 (DE) ..... 10 2010 034 557

(51) Int. Cl.
*A44B 11/26* (2006.01)
*A44B 11/25* (2006.01)

(52) U.S. Cl.
CPC ..... *A44B 11/2515* (2013.01); *A44B 11/2573* (2013.01); *A44B 11/266* (2013.01)
USPC ..... 280/801.1; 24/633

(58) Field of Classification Search
CPC .. A44B 11/26; A44B 11/266; A44B 11/2573; A44B 11/2576
USPC ..... 280/801.1; 297/468, 469, 485; 24/167, 24/592.11, 593.1, 632, 634
See application file for complete search history.

(56) References Cited

U.S. PATENT DOCUMENTS

| | | | | |
|---|---|---|---|---|
| 4,624,033 | A * | 11/1986 | Orton | 24/633 |
| 5,144,725 | A * | 9/1992 | Krauss | 24/625 |
| 5,774,956 | A * | 7/1998 | French et al. | 24/625 |
| D451,842 | S * | 12/2001 | Hamilton | D11/216 |
| 6,463,639 | B1 * | 10/2002 | Mori | 24/633 |
| 6,871,517 | B2 * | 3/2005 | Bonelli et al. | 70/58 |
| 7,150,082 | B2 * | 12/2006 | Beletsky | 24/625 |
| 7,350,277 | B1 * | 4/2008 | Canfield et al. | 24/634 |
| 7,353,573 | B2 * | 4/2008 | Anscher | 24/625 |
| 7,373,701 | B2 * | 5/2008 | Coulombe et al. | 24/648 |
| 8,181,319 | B2 * | 5/2012 | Johnson et al. | 24/648 |

* cited by examiner

*Primary Examiner* — Paul N Dickson
*Assistant Examiner* — Timothy Wilhelm
(74) *Attorney, Agent, or Firm* — Tarolli, Sundheim, Covell & Tummino LLP

(57) ABSTRACT

The invention relates to a seat belt buckle for a seat belt comprising a casing, a locking member for a plug-in latch and an unlocking device (26) for releasing the unlocking member. The unlocking device (26) includes at least two unlocking surfaces (56, 60) which are independent of each other, wherein a predetermined force has to be applied to both unlocking surfaces (56, 60) for operating the unlocking device (26). The unlocking device (26) includes at least one fastening element (30) constituting an engaging connection with the casing, wherein the engaging connection prevents a movement of the unlocking device (26) in an unlocking direction of the locking member and the fastening element (30) has to be moved in a direction perpendicular to the unlocking direction for releasing the engaging connection.

21 Claims, 2 Drawing Sheets

SEAT BELT BUCKLE AND SEAT BELT SYSTEM FOR A VEHICLE

FIELD OF THE INVENTION

The invention relates to a seat belt buckle for a seat belt comprising a casing, a locking member for a plug-in latch and an unlocking device for releasing the locking member as well as a seat belt system for a vehicle.

BACKGROUND OF THE INVENTION

A seat belt is detachably mounted via its plug-in latch to the vehicle body by means of a seat belt buckle. Especially belt buckles are known which are provided as connecting elements for temporary mounting of a seat belt system, for instance in the case of variable single seats of a van. Belt buckles of this type are intended to prevent erroneous release of the belt buckle.

It is the object of the invention to provide a compact seat belt buckle preventing erroneous release of the locking member.

SUMMARY OF THE INVENTION

According to the invention the unlocking device includes at least two unlocking surfaces that are independent of each other and, for operating the unlocking device, a predetermined force has to be applied to both unlocking surfaces. Since both unlocking surfaces have to be operated simultaneously with the predetermined minimum force, the possibility of erroneous release of the locking member by accidentally operating only one of the unlocking surfaces is prevented. The operation of the unlocking device requires coordinated handling of the belt buckle, whereby erroneous release, for instance by children playing with the belt buckle, is rendered improbable.

In order to further reduce the probability of an accidental operation of the unlocking device, the unlocking device can include a third unlocking surface, wherein a defined force has to be applied to all three unlocking surfaces in order to operate the unlocking device.

The unlocking surfaces are supported such that for unlocking they are movable in one direction only.

It is further advantageous when the independent unlocking surfaces are designed for operating the unlocking device so that a force has to be applied to them in different spatial directions.

For instance the independent unlocking surfaces are disposed at different sides of the casing.

In order to prevent the seat belt buckle from being unlocked merely by hand at least one unlocking surface can be in the form of a safety unlocking surface positioned such that the force for unlocking cannot be applied merely by hand but can only be applied by means of a tool.

The safety unlocking surface is arranged, for example, in or below a recess of the casing. This recess is preferably in the form of a slit. In this manner, force can be applied to the safety unlocking surface only via a tool fitting into the recess of the casing.

Furthermore, the object of the invention is achieved by a seat belt buckle comprising the generic features, the unlocking device having at least one fastening element which forms an engaging connection with the casing, wherein the engaging connection prevents the unlocking device from moving in an unlocking direction of the locking member and the fastening element has to be moved in a direction perpendicular to the unlocking direction so as to release the engaging connection. In this way, the seat belt buckle is protected against erroneous release of the locking member by the fact that the unlocking device has to be moved in its unlocking direction while for releasing the engaging connection the fastening element has to be simultaneously moved in a direction perpendicular thereto. Moreover, the seat belt buckle according to the invention prevents the unlocking device from moving in the unlocking direction due to inertia when the seat belt buckle is strongly accelerated.

Preferably two independent fastening elements are provided, each forming an engaging connection with the casing.

It is possible that the two fastening elements are arranged at opposite sides of the casing. In this way both fastening elements are prevented from being released by erroneously touching the belt buckle solely at one side, for instance.

In order to permit a simple design of the seat belt buckle and an easy mounting the unlocking device can be a one-piece component part.

A seat belt system according to the invention for a vehicle comprises an afore-mentioned seat belt buckle, with a plug-in latch being provided which is adapted to be received in the seat belt buckle and is fastened in the seat belt buckle by the locking member.

Preferably the seat belt system includes a belt tensioner.

The belt buckle according to the invention is especially designed to be fixed to a retractor.

The plug-in latch can be provided, for instance, at loop-around fittings or end fittings of the seat belt system. This permits easy mounting of the seat belt system with the belt buckle acting as connecting element which fastens the loop-around fittings and/or end fittings to the vehicle body.

The seat belt system can be provided for a vehicle seat adapted to be installed and removed, the seat belt buckle permitting easy assembly of the seat belt system when installing the seat as well as easy disassembly when removing the vehicle seat.

DESCRIPTION OF THE EXAMPLE EMBODIMENT

The seat belt buckle 10 described hereinafter is provided as connecting element when assembling a seat belt system. The seat belt buckle 10 thus does not primarily serve for fastening and unfastening an occupant's seat belt but for mounting end or loop-around fittings of the seat belt system to the vehicle body, for instance.

Especially the seat belt buckle 10 can be used in a seat belt system for a vehicle seat adapted to be installed and removed.

Figure 1:
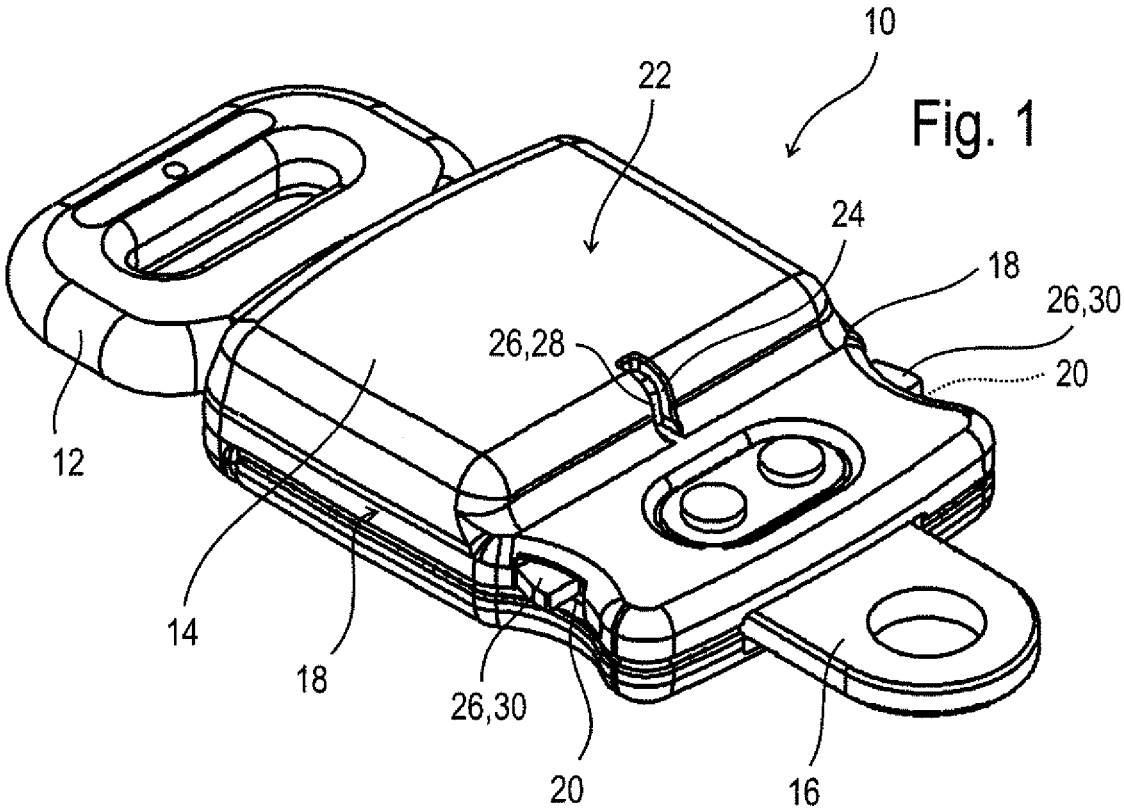
FIG. 1 shows a seat belt buckle according to the invention having an inserted plug-in latch of a seat belt system according to the invention.

FIG. 1 shows a seat belt buckle 10 with a plug-in latch 12 inserted in the same. The plug-in latch 12 forms, for instance, part of the end fittings of the seat belt system.

The seat belt buckle 10 includes a casing 14, wherein a fastening eye 16 projects from the housing 14 at a front end—in the drawing—of the casing 14. The fastening eye 16 serves for fixing the seat belt buckle 10 to the body of a vehicle. At the rear side of the seat belt buckle 10 opposed to the fastening eye 16 the casing 14 includes an opening for inserting the plug-in latch 12.

At each of the two side faces 18 of the casing 14 a lateral recess 20 is provided and at the upper side 22 of the casing 14 a slit-like upper recess 24 is provided.

An unlocking device 26 comprises an operating element 28 provided in the area of the upper recess 24 as well as two fastening elements 30 designed to form an engaging connection with the casing 14 in the area of the lateral recesses 20.

The inner structure of the seat belt buckle 10 and the unlocking device 26 are hereinafter described by way of the FIGS. 2 and 3. In the shown embodiment the casing 14 includes a lower casing shell 32 and an upper casing shell 34.

Inside the casing 14 a belt buckle frame 36 made of a reformed sheet metal is provided. The belt buckle frame 36 is designed to be two-layered, between the sheet layers an eject element 38 being provided which is loaded by an eject spring 40 in the direction of the plug-in latch opening of the seat belt buckle 10.

A locking member 42 is movably supported perpendicularly to the plane of the belt buckle frame 36, wherein the locking member 42 is adapted to engage in recesses in the belt buckle frame 36 and the plug-in latch 12 so as to positively connect the plug-in latch 12 and the seat belt buckle 10. The locking member 42 is forced into its locked position by a locking spring 44.

A guide member 46 is fastened to the belt buckle frame 36 and constitutes a guide for the locking member 42 and the unlocking device 26.

The unlocking device 26 is a one-piece component part and comprises an operating element 28 and two fastening elements 30. The unlocking device 26 is disposed to be movable in the unlocking direction at the guide member 46 and at the belt buckle frame 36. In the embodiment described here this unlocking direction is located in the direction of the longitudinal axis of the seat belt buckle.

Two unlocking springs 48 are provided between the unlocking device 26 and the guide member 46.

The two casing shells 32, 34 and the fastening eye 16 are connected to the belt buckle frame 36 via two rivets 50 and washers 52.

Figure 2:
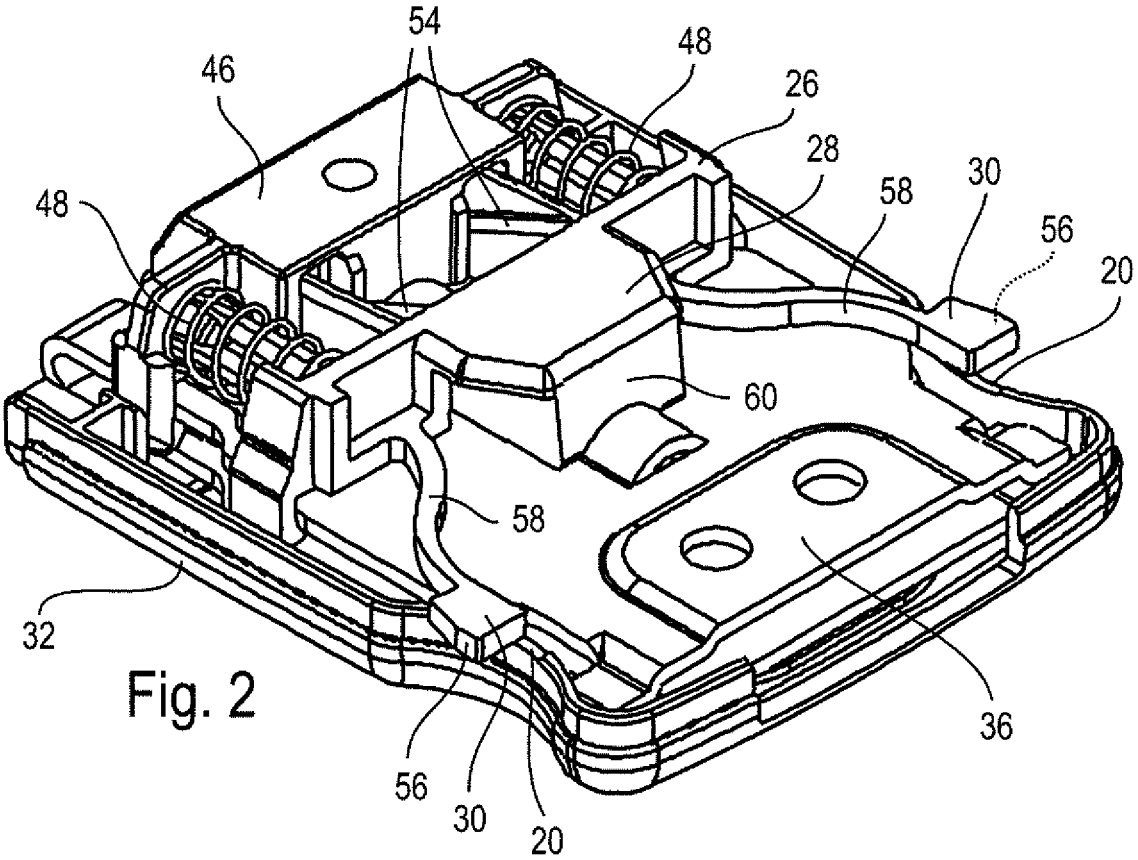
FIG. 2 shows the belt buckle according to FIG. 1 where the casing top is removed.
Figure 3:
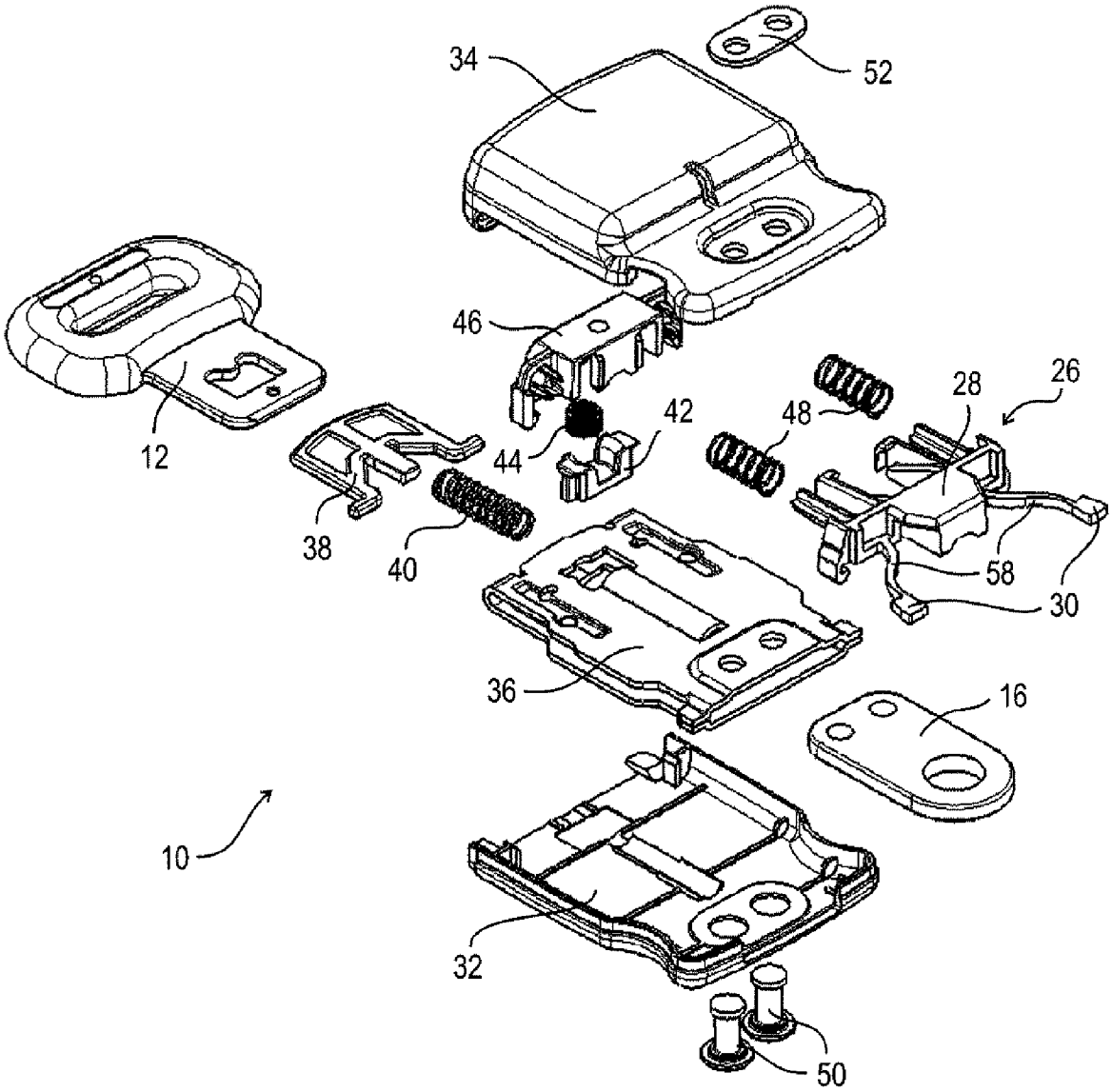
FIG. 3 shows an exploded view of the belt buckle according to FIG. 1.

In FIG. 2 the seat belt buckle 10 is shown with the top housing shell 34 being removed. The unlocking springs 48 force the unlocking device into its home position shown in FIG. 2. At the operating element 28 of the unlocking device 26 two inclined ramps 54 are provided which, upon movement of the unlocking device 26 in an unlocking direction, i.e. in the direction of the guide member 46 or the locking member 42, act on the locking member 42 and raise the same so that the positive connection of the plug-in latch 12 with the seat belt buckle 10 is released.

The eject element 38 loaded by the eject spring 40 ejects the plug-in latch 12 from the seat belt buckle 10 after releasing the positive connection.

At the home position of the unlocking device 26 the fastening elements 30 are engaged in the lateral recesses 20 of the casing 14.

The fastening elements 30 are integrally formed at resiliently formed arms 58 of the unlocking device 26.

Movement of the unlocking device 26 in its unlocking direction is only possible when the engaging connection between the fastening elements 30 and the lateral recesses 20 of the casing 14 is released. For releasing the engaging connection a predetermined force has to be applied to the fastening elements 30 at respective laterally disposed unlocking surfaces 56.

A further central unlocking surface 60 is provided at the operating element 28. Force can be applied to the central unlocking surface 60 only through the upper recess 24 at the upper side 22 of the casing 14.

The central unlocking surface 60 is in the form of a safety unlocking surface, the slit-like upper recess 24 being configured such that a sufficient unlocking force cannot be applied to the central unlocking surface 60 merely by hand. In the shown embodiment the slit of the recess 24 has such narrow form that the unlocking surface 60 cannot be sufficiently moved by a finger tip.

In order to apply the required force to the central unlocking surface 60 a tool is necessary, for instance a screwdriver fitting into the narrow slit of the recess 24 or a special tool.

For moving the unlocking device 26 in the unlocking direction while the fastening elements 30 are released, the force applied to the central unlocking surface 60 must correspond at least to the forces of the unlocking springs 48 and of the locking spring 44 as well as to possible resistances of the mechanism.

For operating the unlocking device 26 a respective predetermined force has to be applied to all three unlocking surfaces 56, 60. In this way, firstly the engaging connections of the fastening elements 30 are released and, secondly, the operating element 28 of the unlocking device 26 is moved in the unlocking direction, thereby releasing the locking member 42 of the seat belt buckle 10.

The unlocking device 26 is designed such that the unlocking surfaces 56, 60 are independent of each other. This means, for instance, that the force exerted on the lateral unlocking surfaces 56 only releases the respective associated fastening element 30 but causes no movement of the unlocking device in the unlocking direction.

In the shown embodiment three unlocking surfaces 56, 60 are provided one of which is a safety unlocking surface and two unlocking surfaces are associated with fastening elements 30. It is also possible that a different number of unlocking surfaces 56, 60 or only one fastening element 30 is provided.

The unlocking surfaces 56, 60 are disposed so that a force has to be applied to them in different spatial directions, wherein a force has to be applied to the lateral unlocking surfaces 56 from the left or the right in lateral direction while a force has to be applied to the central unlocking surface 60 in the unlocking direction. The direction of force of the two lateral unlocking surfaces 56 is perpendicular to the unlocking direction of the unlocking device. As is easily evident from FIG. 1, the unlocking surfaces 56, 60 are arranged at respective different sides of the housing 14.

The special arrangement of the unlocking surfaces 56, 60 requires coordinated handling of the seat belt buckle 10 for operating the unlocking device 26, thereby preventing undesired release of the plug-in latch 12 from the seat belt buckle 10, for instance by a person or an object accidentally touching the seat belt buckle 10 or by children playing with the seat belt buckle 10.

Preferably the arrangement of the unlocking surfaces 56, 60 and of the fastening elements 30 is chosen such that two hands and a tool are required to operate the unlocking device.

Also, a special tool can be provided permitting the predetermined force to be simultaneously applied to all unlocking surfaces 56, 60 in a simple manner.

An engaging connection of the fastening elements 30 and the casing 14 prevents a movement of the unlocking device 26 relative to the casing 14. The sections of the fastening elements 30 facing the upper edge of the recess 20 are bevelled such that an outwardly pointing wedge effect is produced when the fastening elements 30 get into contact with the upper edge of the recess by accelerating the seat belt buckle in the longitudinal direction. In this manner, the seat belt buckle 10 is suited for a seat belt system including a belt tensioner in which the seat belt buckle 10 is exposed to strong accelerations.

The invention claimed is:

1. A seat belt buckle (10) for a seat belt comprising a casing (14), a locking member (42) for a plug-in latch (12) and a one piece unlocking device (26) for releasing the locking member (42), the unlocking device (26) being separate from both the locking member (42) and the plug-in latch (12), wherein the unlocking device (26) has at least two unlocking surfaces (56, 60) which are independent of each other and move relative to each other, wherein a predetermined force has to be applied to both unlocking surfaces (56, 60) for operating the unlocking device (26).

2. The seat belt buckle according to claim 1, wherein the unlocking device (26) has a third unlocking surface (56, 60), wherein a predetermined force has to be applied to all three unlocking surfaces (56, 60) for operating the unlocking device (26).

3. The seat belt buckle according claim 1, wherein force has to be applied to the independent unlocking surfaces (56, 60) for operating the unlocking device (26) in different spatial directions.

4. The seat belt buckle according claim 1, wherein the independent unlocking surfaces (56, 60) are arranged at respective different sides of the casing (14).

5. The seat belt buckle according to claim 1, wherein operation of the unlocking device (26) moves the locking member (42) out of engagement with the plug-in latch (12) to release the locking member (42) from the plug-in latch (12).

6. The seat belt buckle according to claim 5, wherein the unlocking device (26) includes at least one inclined ramp (54) engaging the locking member (42).

7. The seat belt buckle according to claim 1, wherein the locking member engages a recess in the plug-in latch to fasten the plug-in latch in the casing.

8. The seat belt buckle according to claim 7, wherein the locking member is biased into engagement with the recess by a locking spring.

9. The seat belt buckle according to claim 1, wherein the locking member moves in a direction transverse to an insert direction of the plug-in latch to fasten the plug-in latch in the casing.

10. The seat belt buckle according to claim 1, wherein the locking member fastens the plug-in latch in the casing by moving in a direction transverse to a direction in which the predetermined force is applied.

11. The seat belt buckle according to claim 1, wherein the locking member is movable relative to the casing and the unlocking device, the unlocking device being movable relative to the casing and the locking member, the unlocking device moving in a first direction relative to the casing and engaging the locking member to move the locking member in a second direction transverse to the first direction when the predetermined force is applied to both unlocking surfaces.

12. A seat belt buckle (10) for a seat belt comprising a casing (14), a locking member (42) for a plug-in latch (12) and an unlocking device (26) for releasing the locking member (42), the unlocking device (26) being separate from both the locking member (42) and the plug-in latch (12), wherein the unlocking device (26) has at least two unlocking surfaces (56, 60) which are independent of each other, wherein a predetermined force has to be applied to both unlocking surfaces (56, 60) for operating the unlocking device (26), wherein at least one unlocking surface (60) is designed to be a safety unlocking surface positioned so that the force for unlocking cannot be applied merely by hand.

13. The seat belt buckle according to claim 12, wherein the safety unlocking surface (60) is arranged within or below a preferably slit-like recess (24) of the casing (14).

14. A seat belt buckle (10) for a seat belt comprising a casing (14), a locking member (42) for a plug-in latch (12), and an unlocking device (26) separate from the plug-in latch (12) for releasing the locking member (42), wherein the unlocking device (26) has at least two unlocking surfaces (56, 60) which are independent of each other, wherein a predetermined force has to be applied to both unlocking surfaces (56, 60) for operating the unlocking device, wherein the unlocking device (26) includes at least one fastening element (30) constituting an engaging connection with the casing (14), wherein movement of the unlocking device (26) in an unlocking direction of the locking member (42) is prevented by the engaging connection and the fastening element (30) has to be moved in a direction perpendicular to the unlocking direction (26) for releasing the engaging connection.

15. The seat belt buckle according to claim 14, wherein two independent fastening elements (30) are provided each of which forms an engaging connection with the casing (14).

16. The seat belt buckle according to claim 15, wherein the two fastening elements (30) are disposed at opposite sides of the casing (14).

17. The seat belt buckle according to claim 14, wherein the unlocking device (26) is a one-piece component part.

18. A seat belt system for a vehicle comprising a seat belt buckle (10) according to claim 1, wherein a plug-in latch (12) is provided which is adapted to be received in the seat belt buckle (10) and is fastened by the locking member (42) in the seat belt buckle (10).

19. The seat belt system according to claim 18, wherein the seat belt system includes a belt tensioner.

20. A seat belt buckle (10) for a seat belt, comprising:

a casing (14);

a locking member (42) for engaging and fastening a plug-in latch (12) in the casing, the locking member (42) being movable relative to the casing; and a one piece unlocking device (26) for moving the locking member (42) out of engagement with the plug-in latch (12), the unlocking device being movable relative to the casing and the locking member, the unlocking device (26) including at least two independent unlocking surfaces (56, 60) which move relative to each other, the unlocking device (26) moving the locking member (42) relative to the casing out of engagement with the plug-in latch (12) when predetermined forces are applied to the unlocking surfaces (56, 60).

21. A seat belt buckle for a seat belt comprising a casing, a locking member for a plug-in latch, an unlocking device for releasing the locking member, the unlocking device being separate from both the locking member and the plug-in latch, wherein the unlocking device has at least two unlocking surfaces which are independent of each other and move relative to each other, wherein a predetermined force has to be applied to both unlocking surfaces for operating the unlocking device, and at least one spring engaging the unlocking device to bias the unlocking device in a direction in which the plug-in latch is inserted into the casing.

* * * * *